United States Patent [19]

Bubley et al.

BEST AVAILABLE COPY

[11] 3,955,501

[45] *May 11, 1976

[54] SQUEEGEE AND FLOOD BAR ACTUATOR

[75] Inventors: Henry J. Bubley, Deerfield; Claude H. Oltra, Chicago, both of Ill.

[73] Assignee: American Screen Printing Equipment Company, Chicago, Ill.

[ * ] Notice: The portion of the term of this patent subsequent to Jan. 14, 1992, has been disclaimed.

[22] Filed: Jan. 23, 1974

[21] Appl. No.: 435,850

[52] U.S. Cl. ..... 101/123

[51] Int. Cl.[2] ..... B41F 15/36

[58] Field of Search ..... 101/123, 126, 114, 115

[56] References Cited

UNITED STATES PATENTS

| | | | |
|---|---|---|---|
| 1,776,459 | 9/1930 | Tull et al. | 101/123 |
| 2,894,451 | 7/1959 | Landesman | 101/126 |
| 3,731,623 | 5/1973 | Bubley et al. | 101/123 X |
| 3,828,671 | 8/1974 | Fuchs | 101/123 |

*Primary Examiner*—Edgar S. Burr
*Assistant Examiner*—R. E. Suter
*Attorney, Agent, or Firm*—Robert E. Wagner; Robert E. Browne

[57] ABSTRACT

A screen printing press having a support frame, a printing frame pivotally mounted on the support frame and angularly movable relative thereto, a carriage assembly mounted on a pair of spaced support arms mounted on the printing frame, a single drive arm pivotally mounted on the support frame and connected by a drive rod to the carriage assembly to move the carriage assembly relative to a printing screen during a printing cycle, and a carriage assembly actuating means having an actuator channel mounted on spaced parallel legs for movement toward and away from a support arm in generally parallel relationship thereto, an actuating lever mounted for movement along said actuator channel having one end attached to a parallelogram mounting bracket on the carriage assembly on which a squeegee and flood bar are mounted so that upon movement of the actuator channel, the positions of the squeegee and flood bar are reversed, and a control lever pivotally and slidably mounted on the support frame and operatively connected to the actuator channel to control the movement of the actuator channel during a printing cycle.

6 Claims, 8 Drawing Figures

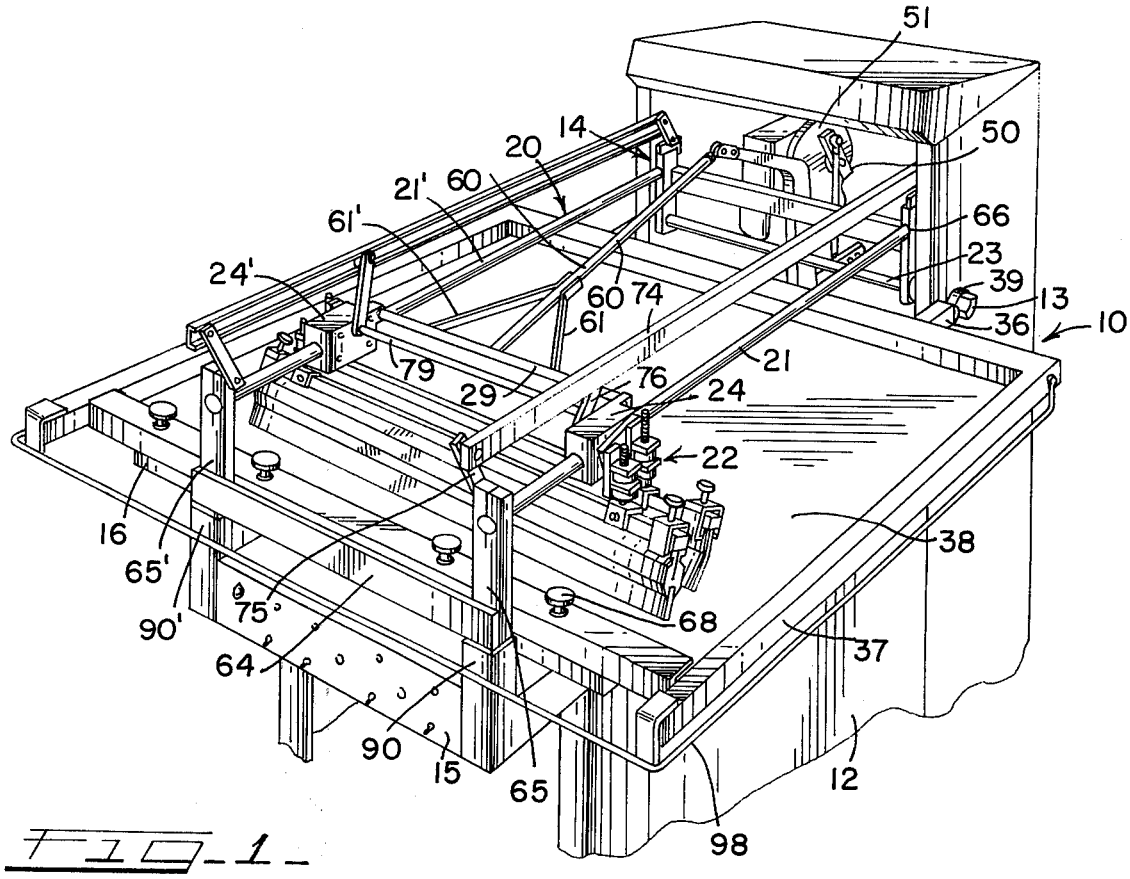
FIG. 1
FIG. 2
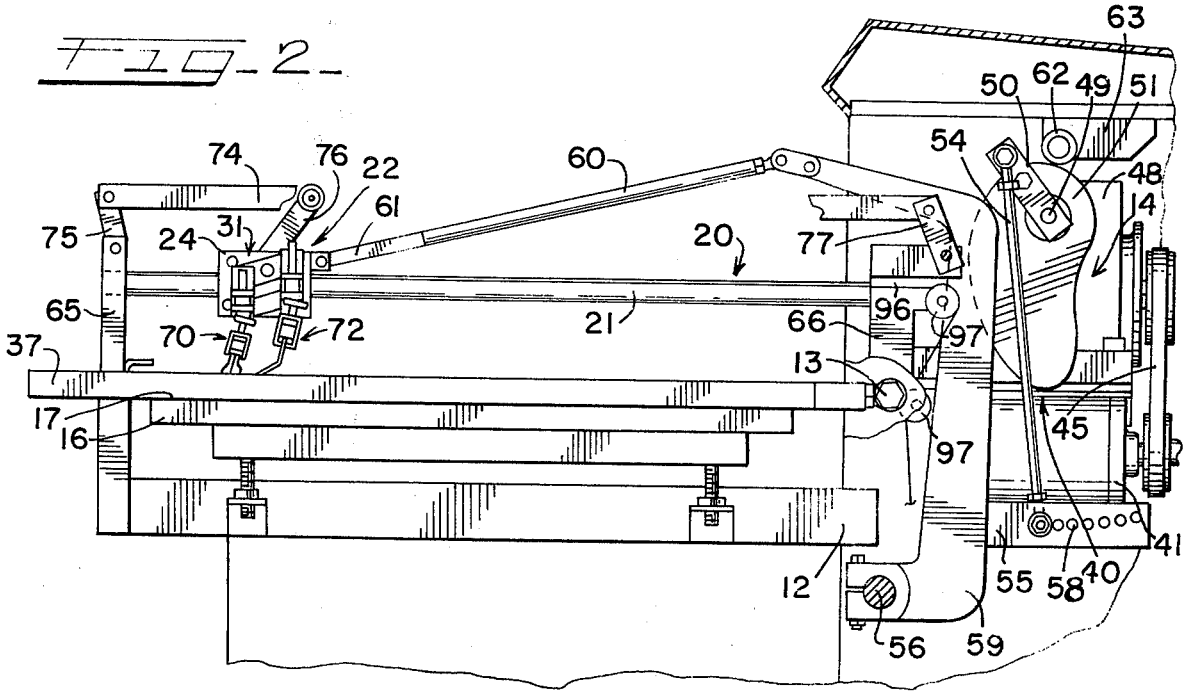

SQUEEGEE AND FLOOD BAR ACTUATOR

BACKGROUND OF THE INVENTION

This invention relates to screen printing presses in general and, in particular, to means for driving a squeegee and flood bar across a printing screen and reversing their position during a press cycle.

In a conventional screen printing operation, during a printing cycle, it is normally necessary to push a pool of ink across the screen toward one end of it, in a "flood stroke," then to place the screen immediately on top of the work, lift the flood bar and lower a squeegee bar extending across the width of the screen into contact with the screen. The rubber squeegee is then drawn in the opposite direction across the screen to force the ink through the screen in the areas desired and thereby print the work.

Various means have been devised to drive a squeegee and a flood bar, mounted on what is often called the "carriage," across the screen and to reverse their positions during the press cycle.

A few of these methods have dealt with the problem of timing the movement of the squeegee and flood bar relative to the screen and to one another during an automated cycle in which the printing head, including the carriage assembly and the chase supporting the screen, are pivoted relative to the printing bed to allow insertion and removal of stock for printing. Gorner (U.S. Pat. No. 1,821,302), Landesman (U.S. Pat. No. 2,894,451) and Walsh, Jr. (U.S. Pat. No. 2,704,510) are disclosed various screen printing machines having apparatus for moving a squeegee and/or flood bar relative to a printing screen and during a printing cycle. U.S. Pat. No. 3,731,623, issued May 8, 1973, to Henry J. Bubley and Claude H. Oltra, and titled "Glider Press" and U.S. Pat. No. 3,859,917 issued Jan. 14, 1975 to American Screen Printing Equipment Company assignee of, Bubley and Oltra and titled "Improvement in a Screen Printing Press," also teach screen printing pressed having apparatus for timed actuation of the squeegee and flood bar. U.S. Pat. No. 3,731,623 and U.S. Pat. No. 3,859,917, which were developed by the same inventors and are assigned to the same assignee as the present invention, are hereby specifically incorporated in the present application in their entireties by reference thereto.

Through application U.S. Pat. No. 3,859,917 contains many unique and desirable features which make it a distinct improvement over the presses of the prior art, including a second frame which pivots, in its entirety, relative to the support frame about pivot points mounted in the plane of and at the rear of the screen, and which also provides for automatic, timed movement of the carriage assembly relative to the angular movement of the printing head, it still, particularly in smaller size presses, has some disadvantages.

The press shown in application U.S. Pat. No. 3,859,917 has a pair of extremely large generally L-shaped drive arms mounted on the support frame, which are connected through connecting rods to opposite ends of the carriage assembly. The carriage assembly is actuated by a shuttle which is allowed to move freely relative to a carriage housing and which operates the squeegee and flood bar mounted on the carriage housing by means of a mounting pin riding in a track formed in the shuttle. When the shuttle contacts bumpers at opposite ends of the support arms, the position of the squeegee and flood bar will be reversed as the mounting pin moves in the shuttle track.

The use of two large, heavy drive arms presents alignment and weight problems and adds to the cost of the presses. The position of each arm relative to their common shaft must be exactly aligned so that the carriage assembly is always perpendicular to its support arms, to assure proper tracking of the carriage relative to the screen. In addition, when the length of the stroke of the carriage assembly is adjusted to correspond to the various sizes of stock to be printed, the bumpers which actuate the shuttle must be removed. If they are not, the carriage may smash into the bumpers and severely damage the head. When these bumpers are moved, they must be carefully aligned in corresponding positions on each arm so that the opposite ends of the squeegee or the flood bar are moved simultaneously. The use of a shuttle or sliding actuator has also resulted in sticking, noise, and high cost of manufacture because of the number of parts. Previous squeegee actuators have also not provided a means of positively locking the squeegee or flood bar in position relative to the fixed frame during the printing stroke.

SUMMARY OF THE INVENTION

The present invention provides simple, inexpensive means for driving the carriage assembly of a screen printing press and positively actuating the squeegee and flood bar carried by the carriage assembly while locking them in a desired position during a printing stroke. This invention eliminates noise, has a minimum number of operating parts and eliminates the need of precisely aligning elements of the carriage assembly upon changing the length of the printing stroke.

This invention accomplishes these objects and overcomes the disadvantages of the prior art by the use of a single drive arm disposed between the spaced parallel support arms of a printing press, such as that shown in U.S. Pat. No. 3,859,917, referred to above. This single drive arm is driven by the press drive means and is operatively connected by a connecting rod to a carriage assembly which is reciprocally movable along the length of the spaced-apart support arms. The carriage assembly has a squeegee and a flood bar mounted on it by means of a pivotal parallelogram mounting structure. In the above application, this mounting structure is operated to position the squeegee and flood bar by freely moving shuttle having an elongated Z-shaped groove formed in it. To eliminate the problems inherent in this shuttle type actuator, the present invention provides an actuating means including an actuator channel which is mounted above at least one of the support arms by a pair of generally parallel downwardly-extending legs pivotal relative to the support arm, and an actuator lever having one end riding, by means of a roller, in the actuating channel and the opposite end fixedly connected to the pivotal parallelogram arrangement on which the squeegee and flood bar are mounted. When the actuator channel is moved relative to the support arm, in constant parallel relationship thereto, the actuator lever is moved angularly to pivot the parallelogram arrangements supporting the ends of the squeegee and flood bar and thereby move the squeegee and flood bar relative to one another, as desired.

Control of the operation of the actuating means is provided by a simply constructed control lever having a lower slotted portion, which slot is mounted in a pivotal manner over a pin fixed on the support frame. The lower portion is thus free to pivot relative to the support frame on the pin and also move linearly relative to the pin in the slot. This portion is threadedly engaged to one end of a connecting rod, and the connecting rod is pivotally joined to a lower portion of the rear actuator channel support leg at its opposite end. A locking block or dog is mounted at a point along the length of the connecting rod to engage a second fixed pin mounted on the support frame to lock the actuating means in a particular fixed position parallel to the support arms during a desired portion of the press cycle and prevent unwanted movement of the squeegee and the flood bar.

The control lever operates to activate the actuator channel in timed relationship to the upward movement of the printing head of the press. As the printing head is rotated upwardly, the upper end of the control lever is moved in a rearward arc, thereby forcing the dog on the control rod portion off of the second pin to unlock the actuator channel. Further upward movement of the printing head causes the lower member of the control lever to be pivoted relative to the first pin and also be moved downwardly in the slot. This allows the actuator channel to be moved toward the support arm, moving the actuator lever angularly to pivot the flood bar into position for the flood stroke. As the head is moved downwardly toward a printing position while the carriage is being driven across the screen to move the ink to the printing position, the actuator channel will again return to its upper position to move the squeegee into position, and the dog on the control rod will become locked over the second pin for the print stroke.

Accordingly, it is an object of the present invention to provide means for driving a carriage assembly of a printing press and operating a squeegee and a flood bar mounted on that assembly in timed relationship to the operation of the printing press during a press cycle.

It is another object of the present invention to provide a single drive arm for a carriage assembly of a screen printing press which is inexpensive in manufacture, significantly reduces press weight, and allows the press to be reduced in size and number of operating parts.

It is still another object of the present invention to provide a single drive arm for a screen printing press which eliminates the need to maintain a constant alignment of a plurality of driving means.

It is one more object of the present invention to provide, in a screen printing press, a carriage assembly driven by a single drive arm and operated by a positive actuator means to reverse the position of the squeegee and flood bar mounted on the carriage assembly.

It is a further object of the present invention to provide an improved carriage assembly for a screen printing press having an improved means for reversing the positions of the squeegee and flood bar which is simple in construction and positive in operation, and does not require any adjustment upon a change in length of the printing stroke.

It is a still further object of the present invention to provide a means for actuating the squeegee and flood bar mounted on the carriage assembly which has few machined parts, does not stick, and creates little noise.

It is one more object of the present invention to provide a means for operating the squeegee and flood bar mounted on a carriage assembly of a printing press which allows the squeegee to be locked in a desired position during the printing stroke.

These and other objects of the present invention will become apparent from the following description taken in conjunction with the drawings wherein:

FIG. 1 is a perspective view of a screen printing press having means for driving and operating a carriage assembly according to the present invention;

FIG. 2 is a side elevational view of the printing press shown in FIG. 1 having the housing over the rear portion of the press cut away;

Figure 4:
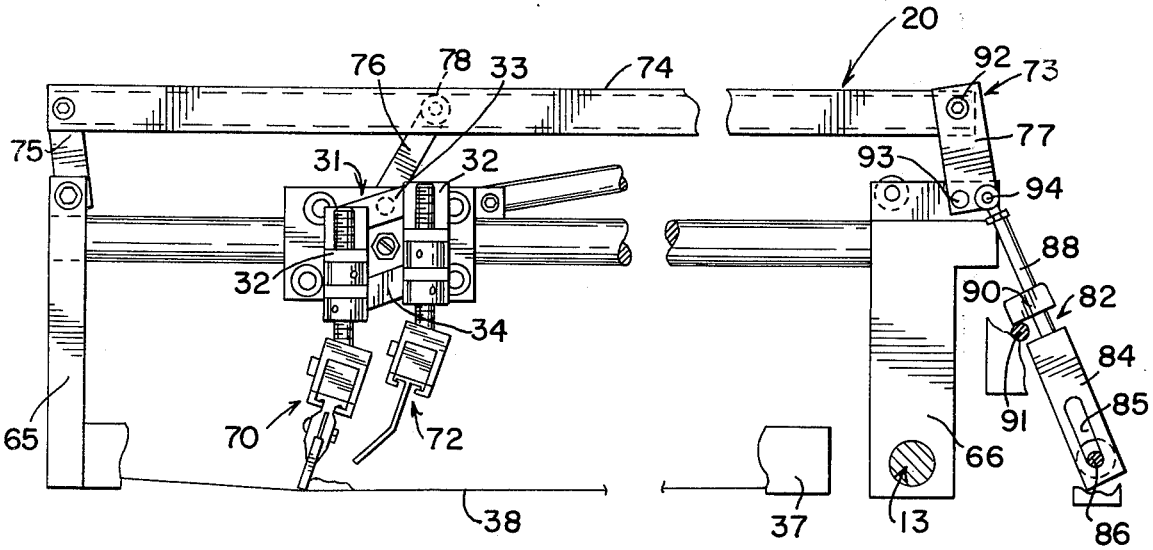
Figure 5:
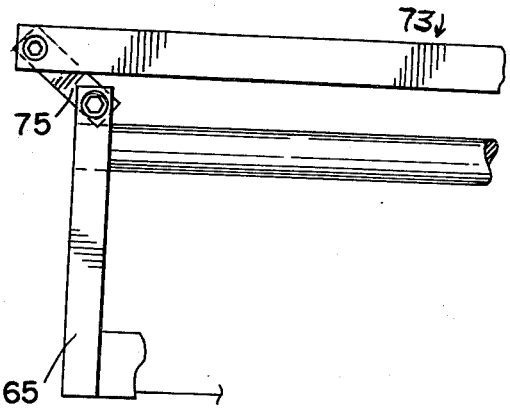
Figure 6:
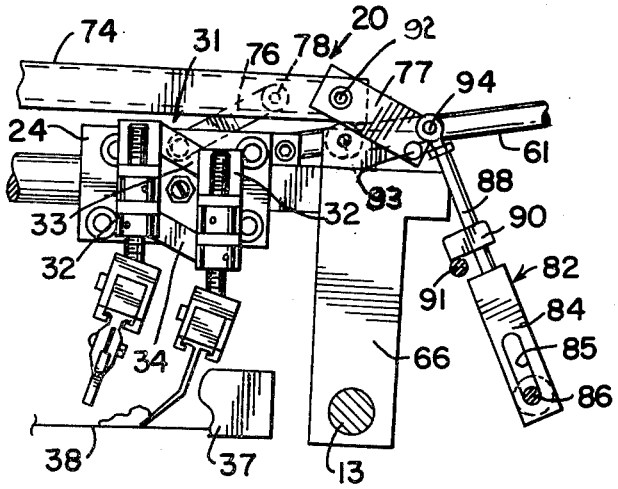
Figure 7:
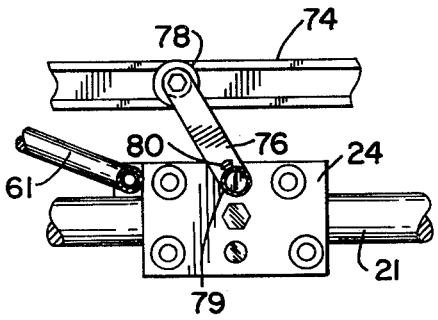
Figure 8:
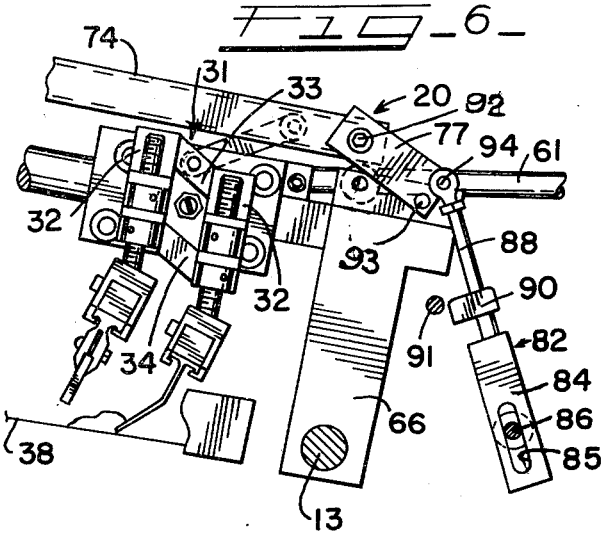
Figure 8:
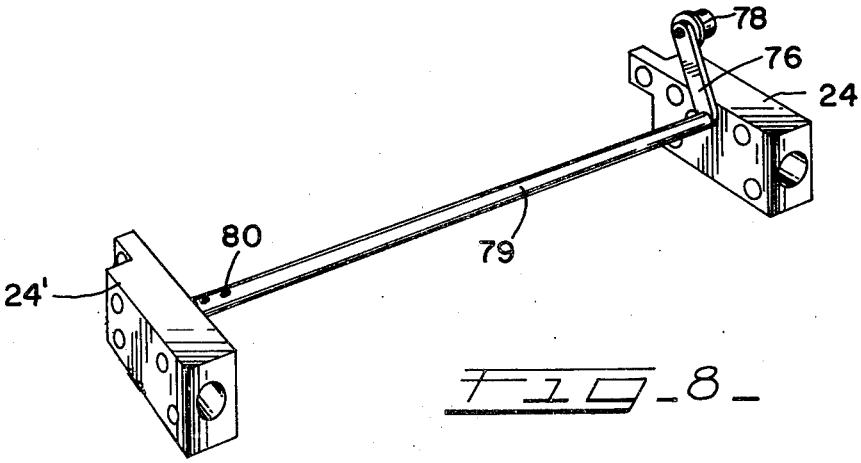

FIGS. 4–6 are side elevational views of a portion of the printing press shown in FIG. 1 illustrating the operation of the means for actuating the carriage assembly wherein FIG. 4 shows the printing head down and the squeegee performing the printing stroke; FIG. 5 shows the carriage assembly at the end of the printing stroke with the printing head beginning to raise; and, FIG. 6 shows the printing head near its uppermost position;

FIG. 7 is a fragmentary elevational view showing the means connecting the actuator channel and housing of the carriage assembly taken generally along line 7—7 of FIG. 1; and FIG. 8 is a free-body diagram illustrating the mounting of the means connecting the actuator channel and the parallelogram means mounting the squeegee and flood bar on the carriage housing.

DESCRIPTION OF THE INVENTION

Referring now to the drawings and, in particular, to FIG. 1, the screen printing press having means for driving and operating a carriage assembly according to the present invention is generally shown at 10. This press 10 includes a first fixed frame 12 having a control console 15 located at its front which permits an operator to control the operation of the press 10. The first frame 12 has a flat printing bed 16 located at its top which is preferably a vacuum base of the type described in now-abandoned application, U.S. Ser. No. 674,623, filed Oct. 11, 1967, entitled "Vacuum Base." A vacuum source (not shown) is mounted on the frame 12 and applies suction to a printing surface 17 of bed 16 to hold the stock or work to be printed on the surface 17 of the bed during a printing cycle. The air flow through the surface 17 may be reversed to provide a blow-back release of the stock after printing.

Screen printing press 10 has a second frame 14 pivotally mounted on first frame 12 at pivot points 13. Second frame 14 is angularly movable relative to first frame 12 on a pivot shaft 23 disposed along a horizontal axis between the pivot points 13 located on opposite sides of frame 12. This shaft 23 is located in approximately the same horizontal plane as the printing surface 17. It is understood that this invention could be used with other screen printing press structures, such as that shown in U.S. Pat. No. 3,731,623.

Second frame 14 includes a screen printing head, indicated generally at 20, which preferably includes a pair of spaced, parallel support arms 21 and 21′, having a carriage assembly 22 mounted thereon for movement therealong. It is understood that where the weight of the carriage assembly 22 does not require it and stability is not a problem, a single support arm could be used. The carriage assembly 22 includes carriage housings 24 and 24′ disposed on each of the support arms 21 and 21′, respectively. These carriage assemblies 24 and 24′ are mirror images of one another and are linked together for a unitary movement by a rear joining rod 29.

A master frame or chase 37 is disposed below support arms 21 and 21' and is mounted for independent pivotal movement about shaft 23 on spherical bearing 39 and a bracket 36 disposed on opposite sides of frame 12. The chase 37 is movably attachable at its forward or front end to a lateral brace 64 joined to vertical braces 65 and 65' which extend downwardly from support arms 21 and 21' to assure rigidity of the chase 37. This mounting enables the chase 37 to be raised with the printing head 20 during the printing cycle and also permits the chase 37 to be lowered independently of the head, for purposes of changing the stencil screen 38, by detaching the forward end of the chase 37 from the lateral brace 64. The stencil screen 38 is held in the chase 37 by clamps 68. The entire printing head will bear on stops 90 and 90' during the printing stroke to assure proper screen position relative to the stock to be printed.

Figure 3:
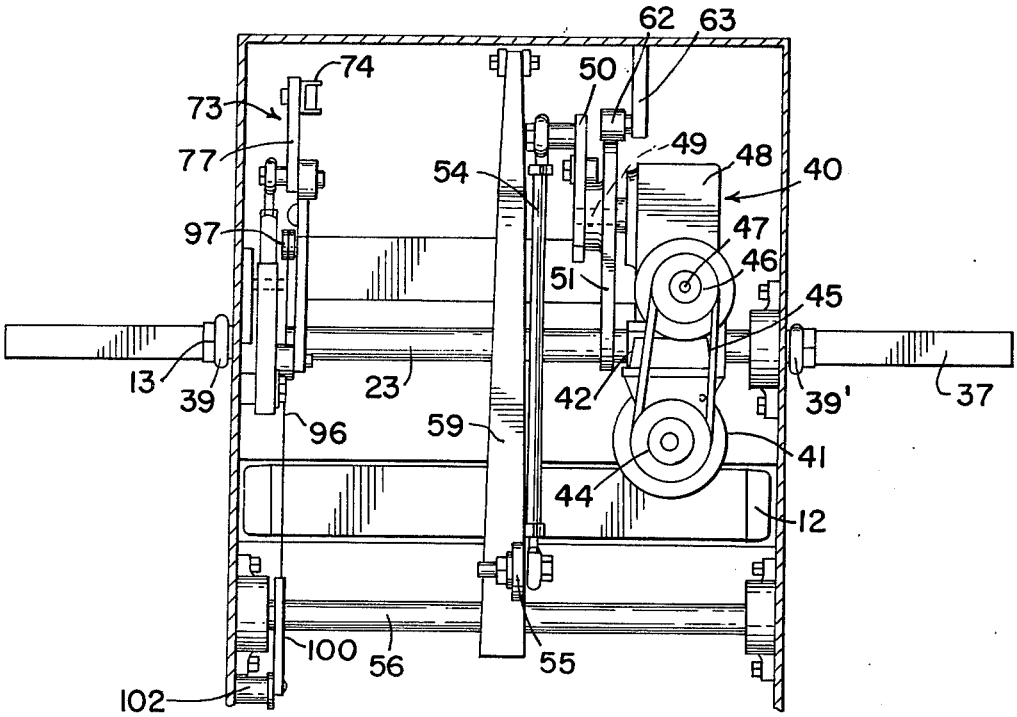
FIG. 3 is a rear elevational view of the printing press shown in FIG. 1 having the back of the housing at the rear of the press cut away to show the press drive means.

The press drive means 40 is mounted on a rearward portion of second frame 14 disposed to the rear of pivot points 13 as shown in FIGS. 2 and 3. This drive means 40 includes a motor 41 positioned on a support 42. A variable speed drive pulley 44 is mounted on motor 41 and, through a belt 45, drives a pulley 46 mounted on an input shaft 47 of a reduction gear arrangement 48. The reduction gear arrangement 48 is of a known type having an output shaft 49 disposed at right angles to the input shaft 47 from one side thereof. Output shaft 49 is rotated to drive a press lift cam 51, which is mounted thereon, and a main drive lever arm 50. Cam 51 is a variable radius cam which engages a cam follower 62 mounted on a rigid cam follower mounting 63 fixed to first frame 12 to thereby pivot second frame 14 about shaft 23 in timed relationship to the movement of carriage assembly 22 as is explained in detail in U.S. Pat. No. 3,859,917. The main drive lever arm 50 is connected through a second arm 54 and a cantilevered arm 55 to a single, integrally formed, generally U-shaped drive arm 59 which has one end fixedly mounted on a rotatable shaft 56 extending through bearings positioned on the first frame 12, and which is pivotally joined, at its opposite end, to a drive rod 60. This drive arm 59 is preferably disposed approximately midway between the support arms 21 and 21'. Movement of shaft 49 thereby moves the printing head 20 angularly while the carriage assembly 22 is being moved linearly along arms 21 and 21' relative to the screen.

Connecting rod 60 is connected, at its opposite end, to the rear joining rod 29 which joins the carriage housing 24 and 24' of the carriage assembly 22. Yoke supports 61 and 61' also serve join rods 60 and 29 and assist in driving the carriage assembly. As drive arm 59 is pivoted on frame 12 with shaft 56 by press drive 40, it acts to drive the carriage assembly 22 in forward and return strokes across bed 16 on arms 21 and 21'. The length of stroke made by the drive arm and carriage assembly is variable by adjusting the position of arm 54 in the holes 58 made in cantilevered arm 55. Since shaft 56, shaft 23 and output shaft 49 are always maintained in fixed spaced relationship, the length of the stroke obtained by the positioning of arm 54 in each particular hole 58 in arm 55 may be readily determined.

Carriage housing 24 mounted on arm 21, has nylon guides (not shown) provided within the housing to assure smooth and friction free movement of the housing along the arm 21 during the printing cycle. A movable parallelogram support 31 is disposed on the outside of housing 24. This support is formed of a top member 33, a bottom member 34 and side members 32 which are pivotally connected to one another so that a parallelogramatic relationship always exists between them. The top member 33 and bottom member 34 are mounted for pivotal movement relative to the housing to cause the side members 31 to move in vertically opposite directions. One side member supports a squeegee assembly 70 and the opposite side member supports a flood bar assembly 72. The top member 33 may be formed in a T-shape with a shaft extending through the carriage housing 24. The opposite end of this shaft (not shown) may be fixedly connected to an actuating means 73 which includes a lower end of an actuator lever 76. The upper end of this actuator lever includes a roller 78 disposed for movement within an actuator channel 74 spaced above and in parallel relationship to the support arm 21. The actuator channel 74 is positioned above the support arm 21 by forward and rear leg members 75 and 77, respectively, which are pivotally pinned near their opposite ends to the forward vertical support 65 and the rear vertical support 66 of the support arm 21. Thus, the actuator channel 74 and the forward and rear legs 75 and 77 form a parallelogram with the support arm 21.

Movement of the actuator channel 74 toward and away from the support arm 21 will cause a corresponding pivotal movement of the actuator lever 76 and thereby the parallelogram support 31 on which the squeegee assembly 70 and flood bar 72 are mounted. This pivotal movement will cause the positions of the squeegee and flood bar to be reversed as desired during a printing cycle. A connecting shaft 79 extends between carriage housings 24 and 24' to assure that the parallogram supports on each housing are pivoted in unison. This connecting shaft may be mounted by set screws 80 on an extension of the shaft extending from top member 33 through the carriage housing, may be a solid shaft extending through each carriage housing with top member 33 welded to the ends thereof, or may be any other suitable structure to provide the desired result.

A control lever means 82 actually controls the movement of the actuating means 73 to operate the position of the squeegee and the flood bar and coordinates this movement with the movement of the printing head and carriage assembly during a press cycle. This control lever means 82 includes a lower member 84, generally rectangular in configuration, having an elongated slot 85 formed along the longitudinal axis thereof, as shown in FIG. 3. This slot 85 is mounted over a first fixed pin 86 which is attached to frame 12. The opposite end of the lower member 84 is formed to threadedly engage an upper rod 88 at one end of the rod, the opposite end of the rod being pivotally connected at point 94 to the rearward leg 77 supporting the actuator channel 74. Rearward leg 77 is pivotally pinned to the channel 74 at point 92 and pivotally pinned to rear vertical support 66 at point 93. Mounted on rod 88 toward lower member 84 is a dog 90 which, during the movement of the control lever means 82, positions itself over a second fixed pin 91 attached to support frame 12 to lock control lever means 82 and thereby actuating means 73, squeegee 70, and flood bar 72 into a desired position during a selected portion of the press cycle.

It has been found that single actuating means 73 and control lever means 82, are usually adequate to easily operate the squeegee and flood bar supported by carriage housings 24 and 24'. However, it may be necessary, in extremely large presses to include a mirror-image actuating means and control lever means adjacent support arm 21', as shown in FIG. 1.

The operation of the screen printing press 10, including the means for driving and actuating the squeegee and flood bar according to this invention, will be described in relation to the fragmentary views of the printing head 20 shown in FIGS. 4–6. With the printing head in a down position, adjacent the printing bed 16, the ink is moved rearwardly across the surface of the screen by the squeegee during the printing stroke, as shown in FIG. 4. During this stroke, the actuator channel 74 is in its uppermost position to thereby cause the parallelogram support 31 to be pivoted to accurately position the squeegee. The control lever means 82 is positioned so that the first fixed pin is at the bottom of the elongated slot 85 and the dog 90 is locked over the second fixed pin 91 to prevent movement or vibration of the carriage assembly and the squeegee during this critical stroke. When the carriage assembly 22 has completed the printing stroke, the printing head 20 begins to rotate upwardly due to the rotation of cam 51. The control lever means 82, while remaining engaged over the pin 91, as shown in FIG. 5, also begins to pivot rearwardly around the first pivot pin 86. However, the rear support leg 77 for the actuator channel 74 pivots forwardly around its pivotal connection 93 to the vertical support 66 and its pivotal connection 92 to the actuator channel 74, to allow the actuator channel 74 to be moved into its lower position and thereby pivot the parallelogram support 31 to lower the flood bar 72 and raise the squeegee 70. This angular movement of actuator channel 74 relative to support arm 21 is caused by the resistance to movement of the actuator channel with the support arm created by control lever 82 which is locked in position over second pin 91 by dog 90. Control lever 82 is connected at a corner of the rear leg 77, opposite the point 93 where this leg is pinned to support 66. The resistance to movement of this corner 94 causes the rear leg to be pivoted forwardly to move the actuator channel 74 to its lower position.

As the printing head continues to pivot upwardly, however, the linear distance this corner of the printing head is moved toward the rear of the press eventually becomes great enough to disengage the dog 90 from the pin 91. The control lever 82 will then begin to move downwardly in its slot 85 over pin 86, as shown in FIG. 6. At approximately this point the flood stroke will begin to carry the ink to the front of the screen. The head 20 will continue to move upward until the pin 86 is disposed at the top end of slot 85 to allow new stock to be placed on bed 16.

In timed relationship to the movement of the carriage assembly by the drive arm, as set forth in detail in U.S. Pat. No. 3,859,917 the printing head, after reaching its point of greatest upward movement, will begin to move downwardly toward the printing bed again. When approximately three-quarters of the flooding is completed and the head 20 is halfway down, the control lever 82 will have moved so that pin 86 is again disposed at the lower end of slot 85. Further movement of head 20 causes dog 90 to engage second pin 91, and for the same reasons as previously stated, opposite forces now cause actuator channel 74 to be moved to an upward position. At the end of the flood stroke and the start of the print stroke, the press is again in the condition shown in FIG. 4.

In many types of screen printing, particularly when a screen material has appreciable stretch, it is desirable to use what is known in the art as off-contact printing. This type of printing is achieved by lifting or peeling the stencil screen behind the squeegee as the squeegee is moved along the support arms in the print stroke. Peeling may be accomplished in the present invention by a mechanism generally including peeling cables 96, which extend from the forward end of each support arm 21 where they are releasably attached to chase 37, through the arm and rearwardly over peeling pulleys 97 to lever arm 100 mounted on stub shaft 102 for rotation therewith. As shaft 56 rotates in response to movement of arm 55, a cam (not shown) mounted thereon engages lever 100 to exert a pulling force on the cables, lifting the chase in opposition to the downward pressure of the squeegee assembly on the stencil screen. Peeling may also be accomplished by various other structures, such as that disclosed in U.S. Pat. No. 3,731,623 and U.S. Ser. No. 299,689 to achieve either uniform or harmonic rates of peel, as desired. The point of attachment of the cable 96 to lever arm 100 may be adjusted along the lever arm to vary the amount of peel. The rate of peel, from uniform to harmonic, can be adjusted by changing the shape of the cam as necessary.

There is also shown in the present invention a safety bar 98 disposed around the sides and front of the chase. Should the operator's hand or a foreign object intervene between the chase and the printing bed as the chase is moved to a downward position, bar 98 will first contact the object and cause the press to automatically shut off to prevent injury.

The present invention is rugged in design and constructed of standard, generally available materials, which makes it quite economical to manufacture. Upon consideration of the foregoing, it will become obvious to those skilled in the art that various modifications may be made without departing from the invention embodied herein. Therefore, only such limitations should be imposed as are indicated by the spirit and scope of the following claims.

We claim:

1. In a printing press including a support frame, a bed supported on said frame and having an upwardly facing surface to receive work to be printed, a printing frame pivotally mounted on said support frame for angular movement relative thereto, a pair of support arms mounted on said printing frame for pivotal movement therewith toward and away from a printing bed, a chase pivotally mounted beneath said pair of support arms and being positioned over said work on said bed, a screen removably mounted on said chase, a carriage assembly mounted on said pair of support arms for movement therealong relative to said chase and screen, said carriage assembly having a squeegee and flood bar mounted for movement relative to one another thereon, a drive arm pivotally mounted on said support frame and operatively connected to said carriage assembly, and press drive means operatively connected to said drive arm to drive said drive arm and thereby move said carriage assembly reciprocally along said pair of support arms during a press cycle, the improvement including a carriage assembly actuating assembly mounted on said printing frame in generally parallel relationship to said pair of support arms, said actuating assembly having an elongated member operatively connected to said squeegee and flood bar by an actuator lever movable along said elongated member, said elongated member being movable toward and away from said pair of support arms and maintained in constant parallel relationship thereto by a pair of parallel legs, one of said pair of legs being pivotally mounted near each end of said elongated member, each of said pair of legs having one end thereof mounted on said elongated member, an opposite end of each of said pair of legs being mounted on one of said pair of said support arms, and a control lever assembly pivotally mounted on said support frame and operatively connected to said carriage assembly actuating assembly to move said actuating assembly relative to said pair of support arms to reverse the respective positions of said squeegee and said flood bar during said press cycle in response to the movement of said printing frame relative to said support frame and said printing bed, said control lever assembly having a lower portion with a slot formed therein which is mounted over a fixed pivot pin attached to said support frame, said slot allowing said control lever assembly to slide relative to said pivot pin and said support frame while being pivoted relative thereto, and an upper connecting portion adjustable in length relative to said lower portion of said control lever assembly, an upper end of said upper connecting portion of said control lever assembly being pivotally connected to said actuating assembly, a locking dog mounted on said control lever assembly and engaging a locking pin fixedly mounted on said support frame as said control lever assembly slides by said slot relative to said pivot pin on said support frame, to thereby lock said control lever assembly into a selected position preventing linear movement of said control lever assembly relative to said pivot pin at selected times during said press cycle and prevent unwanted movement of said actuating assembly.

2. A printing press including a support frame, a bed supported on said support frame and having an upwardly facing surface to receive work to be printed, a printing frame pivotally mounted on said support frame for angular movement relative thereto, said printing frame having a pair of support arms mounted on a front portion thereof for pivotal movement therewith toward and away from said bed, a chase pivotally mounted beneath said support arms and being positioned over said work on said bed, a screen removably mounted on said chase, a carriage assembly mounted on said support arms for movement theralong relative to said chase and said screen, a drive arm pivotally mounted on said support frame and operatively connected to said carriage assembly, a press drive mounted entirely on a rear portion of said printing frame and operatively connected to said drive arm to drive said drive arm and thereby move said carriage assembly reciprocally along said support arms during a printing cycle, means operatively connecting said press drive to said drive arm, said press drive operatively engaging said support frame to pivotally move said printing frame relative to said support frame about a pivot point disposed generally in the horizontal plane of said surface of said bed adjacent a rear edge of said surface during said printing cycle, said carriage assembly having a squeegee and flood bar mounted thereon, at least one carriage assembly actuating assembly mounted on said printing frame and disposed for movement relative to said support arms in generally parallel relationship thereto, said actuating assembly being operatively connected to said carriage assembly and operating to reverse the respective positions of said squeegee and said flood bar during said printing cycle by its movement relative to said support arms, a control lever pivotally mounted on said support frame and operatively connected to said actuating assembly to control the movement of said actuating assembly during the printing cycle and thereby control the movement of said squeegee and flood bar relative to said screen during said printing cycle.

3. The printing press of claim 2 wherein said support arms are spaced-apart and mounted on said printing frame and extending generally parallel to said chase and said screen during said printing cycle, and said drive arm is a single arm pivotally mounted on said support frame and generally located between said spaced-apart arms, said drive arm being operatively connected to said carriage assembly mounted on said pair of support arms and acting to drive said carriage assembly in reciprocal fashion along said pair of support arms.

4. The printing press of claim 2 wherein said pair of support arms extend generally parallel to said chase and said screen during said printing cycle, and said carriage assembly includes a carriage housing mounted for movement on said support arms, means on said carriage housing for supporting a squeegee and a flood bar in associated relationship for movement relative to one another, corresponding to the positioning of said screen over said bed, said squeegee being brought into contact with said screen when said screen is in engagement with said work, and said actuating assembly includes an elongated member operatively connected to said means on said carriage housing for supporting said squeegee and said flood bar, said elongated member being movable in constant parallel relationship to said pair of support arms, to shift said squeegee and said flood bar relative to one another during a press cycle to properly position the same during movement of said carriage assembly on said support arms in response to the movement of said printing frame relative to said bed.

5. The printing press of claim 4 wherein said elongated actuator member is mounted on said printing frame adjacent at least one of said support arms and parallel thereto, said actuator member being movable toward and away from said one of said support arms in timed relationship to the movement of said printing frame relative to said support frame and said bed while being maintained in said parallel relationship to said one of said support arms, and said control lever being connected to said actuator member such that, as said actuator member is moved angularly with said printing frame relative to said support frame and said bed, said control lever, will resist such movement and thereby cause said actuator member to be moved toward or away from said one of said support arms, causing said squeegee and said flood bar to be shifted by said actuator member.

6. The printing press of claim 4 wherein said actuating assembly includes an actuator lever having one end thereof connected to said means supporting said squeegee and said flood bar on said carriage housing and pivotally movable relative to said carriage housing, said opposite end of said actuator lever being mounted on said elongated actuator member for movement therealong, said actuator lever being pivotally moved relative to said carriage housing upon movemenet of said actuator member relative to said pair of support arms to thereby pivot said means supporting said squeegee and said flood bar to reverse the respective positions of said squeegee and said flood bar.

* * * * *